US010366675B2

(12) United States Patent
Koizumi

(10) Patent No.: US 10,366,675 B2
(45) Date of Patent: Jul. 30, 2019

(54) LIQUID CRYSTAL DISPLAY DEVICE AND METHOD FOR DRIVING SAME

(71) Applicant: SHARP KABUSHIKI KAISHA, Sakai, Osaka (JP)

(72) Inventor: Ryohei Koizumi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 15/565,656

(22) PCT Filed: Apr. 1, 2016

(86) PCT No.: PCT/JP2016/060903
§ 371 (c)(1),
(2) Date: Oct. 10, 2017

(87) PCT Pub. No.: WO2016/163314
PCT Pub. Date: Oct. 13, 2016

(65) Prior Publication Data

US 2018/0096669 A1 Apr. 5, 2018

(30) Foreign Application Priority Data

Apr. 10, 2015 (JP) ..... 2015-080618

(51) Int. Cl.
*G09G 5/10* (2006.01)
*G09G 3/36* (2006.01)
*G09G 3/34* (2006.01)

(52) U.S. Cl.
CPC ..... *G09G 5/10* (2013.01); *G09G 3/3648* (2013.01); *G09G 3/3413* (2013.01);
(Continued)

(58) Field of Classification Search
CPC ..... G09G 5/10; G09G 3/3648; G09G 3/3413; G09G 2300/0452; G09G 2310/0235;
(Continued)

(56) References Cited

U.S. PATENT DOCUMENTS 7,176,879 B1 * 2/2007 Yoshihara ..... G09G 3/3413 345/102
7,522,136 B2 * 4/2009 Park ..... G09G 3/3413 345/690

(Continued)

FOREIGN PATENT DOCUMENTS

JP 2004-191836 A 7/2004
JP 2005-134724 A 5/2005

(Continued)

*Primary Examiner* — Tom V Sheng
(74) *Attorney, Agent, or Firm* — ScienBiziP, P.C.

(57) ABSTRACT

An object of the present invention is to implement a liquid crystal display device employing a field sequential system and capable of suppressing degradation of image quality caused by liquid crystal response characteristics. A liquid crystal display device is provided with a liquid crystal panel displaying an image formed of a plurality of pixels; a gradation value compressing unit generating compressed data by performing a compression process which is a process of correcting input gradation data such that a difference between a maximum gradation value and a minimum gradation value is reduced; and a liquid crystal panel driving unit driving the liquid crystal panel based on the compressed data. The gradation value compressing unit performs the compression process such that values of input gradation data of a plurality of colors corresponding to a plurality of fields forming one frame period change at the same ratio.

9 Claims, 18 Drawing Sheets

(52) U.S. Cl.
CPC ..... *G09G 2300/0452* (2013.01); *G09G 2310/0235* (2013.01); *G09G 2320/0252* (2013.01); *G09G 2320/0257* (2013.01); *G09G 2320/0261* (2013.01); *G09G 2320/0271* (2013.01); *G09G 2340/0428* (2013.01)

(58) Field of Classification Search
CPC ... G09G 2320/0252; G09G 2320/0257; G09G 2320/0261; G09G 2320/0271; G09G 2340/0428
See application file for complete search history.

(56) References Cited

U.S. PATENT DOCUMENTS 8,638,289 B2 * 1/2014 Iisaka ..... G09G 3/3413 345/102
2002/0034336 A1 * 3/2002 Shiota ..... H04N 1/4092 382/274
2007/0024558 A1 2/2007 Oura
2007/0188623 A1 * 8/2007 Yamashita ..... G06T 5/004 348/222.1
2008/0186328 A1 * 8/2008 Mawatari ..... G09G 3/2092 345/604
2009/0015532 A1 * 1/2009 Katayama ..... G09G 3/3406 345/89
2009/0109211 A1 * 4/2009 Nose ..... G09G 3/3688 345/214
2009/0225096 A1 * 9/2009 Yoshiga ..... G09G 3/3648 345/545
2013/0057599 A1 3/2013 Teranuma et al.
2014/0099025 A1 * 4/2014 Suzuki ..... H04N 19/597 382/166
2014/0146098 A1 * 5/2014 Furihata ..... G09G 5/00 345/694
2015/0279290 A1 * 10/2015 Nakahata ..... G09G 3/2092 345/549
2015/0339968 A1 11/2015 Yoshioka et al.
2015/0356899 A1 * 12/2015 Yamanaka ..... G09G 3/3225 345/690

FOREIGN PATENT DOCUMENTS

JP 2007-33864 A 2/2007
JP 2009-20340 A 1/2009
JP 2010-250193 A 11/2010
WO 2011/148704 A1 12/2011
WO 2014/097925 A1 6/2014

* cited by examiner

129

DISPLAY-FIELD VALUE

PREVIOUS-FIELD VALUE

| | 0 | 32 | 64 | 96 | 128 | 160 | 192 | 224 | 255 |
|---|---|---|---|---|---|---|---|---|---|
| 0 | 0 | 34 | 70 | 108 | 144 | 207 | 240 | 255 | 255 |
| 32 | 0 | 32 | 65 | 100 | 140 | 193 | 238 | 255 | 255 |
| 64 | 0 | 30 | 64 | 98 | 138 | 187 | 224 | 254 | 255 |
| 96 | 0 | 28 | 58 | 96 | 132 | 181 | 212 | 250 | 255 |
| 128 | 0 | 25 | 55 | 83 | 128 | 165 | 210 | 245 | 255 |
| 160 | 0 | 19 | 49 | 80 | 122 | 160 | 208 | 240 | 255 |
| 192 | 0 | 16 | 48 | 81 | 114 | 142 | 192 | 230 | 255 |
| 224 | 0 | 10 | 34 | 61 | 108 | 130 | 181 | 224 | 255 |
| 255 | 0 | 0 | 32 | 58 | 102 | 124 | 172 | 208 | 255 |

Fig.11

140

| INPUT VALUE | OUTPUT VALUE |
|---|---|
| 0 | 0 |
| 1 | 1 |
| 2 | 2 |
| ⋮ | ⋮ |
| 127 | 114 |
| 128 | 115 |
| 129 | 116 |
| ⋮ | ⋮ |
| 253 | 228 |
| 254 | 229 |
| 255 | 230 |

LIQUID CRYSTAL DISPLAY DEVICE AND METHOD FOR DRIVING SAME

TECHNICAL FIELD

The present invention relates to a liquid crystal display device, and more specifically to a liquid crystal display device employing a field sequential system and a method for driving same.

BACKGROUND ART

In general, in a liquid crystal display device that performs color display, one pixel is divided into three subpixels: a red pixel provided with a color filter that allows red light to be transmitted therethrough; a green pixel provided with a color filter that allows green light to be transmitted therethrough; and a blue pixel provided with a color filter that allows blue light to be transmitted therethrough. While color display can be performed using the color filters provided in the three subpixels, about two-thirds of backlight light irradiated onto a liquid crystal panel is absorbed by the color filters. Hence, a liquid crystal display device employing a color filter system, has a problem of low light use efficiency. Hence, attention is focused on a liquid crystal display device employing a field sequential system that performs color display without using color filters.

In a general liquid crystal display device employing the field sequential system, one frame period which is a display period of one screen is divided into three fields. Note that although the field is also called a subframe, in the following description, the uniform term "field" is used. For example, one frame period is divided into a field (red field) in which a red screen is displayed based on a red component of an input image signal; a field (green field) in which a green screen is displayed based on a green component of the input image signal; and a field (blue field) in which a blue screen is displayed based on a blue component of the input image signal. By displaying the primary colors one by one in the above-described manner, a color image is displayed on a liquid crystal panel. Since a color image is displayed in this manner, the liquid crystal display device employing the field sequential system does not require color filters. By this, the liquid crystal display device employing the field sequential system has light use efficiency that is about three times as high as the liquid crystal display device employing the color filter system. Therefore, the liquid crystal display device employing the field sequential system, is suited for increasing luminance and reducing power consumption.

Meanwhile, in a liquid crystal display device, image display is performed by controlling the transmittance of each pixel by a voltage (voltage applied to liquid crystal). In this regard, it takes several milliseconds for the transmittance of a pixel to reach its target transmittance after starting the writing of data (the application of a voltage) into the pixel. Hence, in the liquid crystal display device employing the field sequential system, in each field, a backlight of a corresponding color is switched from, a light-off state to a light-on state after the liquid crystal has responded to a certain extent.

In addition, in the liquid crystal display device, a sufficient image quality may not be obtained, for example, upon displaying a moving image, due to the low response speed of the liquid crystal. In view of this, as measures against the low response speed of the liquid crystal, a drive system called overdrive (overshoot drive) is conventionally adopted. The overdrive is a drive system in which a drive voltage higher than a predetermined gradation voltage corresponding to the data value of the input image signal for the current frame or a drive voltage lower than the predetermined gradation voltage corresponding to the data value of the input image signal for the current frame is supplied to the liquid crystal panel in accordance with a combination of the data value of an input image signal for the previous frame and the data value of an input image signal for the current frame. That is, the overdrive leads to correction of an input image signal that emphasizes a temporal change (but not a spatial change) in data value. By adopting such overdrive, in the current liquid crystal display device employing the color filter system, the liquid crystal responds such that the transmittance almost reaches its target value (target transmittance) in each field.

Note that in relation to an invention of this matter, the following prior art document is known. Japanese Laid-Open Patent Publication No. 2010-250193 discloses an invention of a video display device in which the liquid crystal response time required to obtain a desired gradation value is reduced by changing the display order of colors on a frame-by-frame basis such that a gradation change between fields is reduced.

PRIOR ART DOCUMENT

Patent Document

[Patent Document 1] Japanese Laid-Open Patent Publication No. 2010-250193

SUMMARY OF THE INVENTION

Problems to be Solved by the Invention

As described above, the current liquid crystal display device employing the color filter system, adopts the overdrive, by which the liquid crystal responds such that the transmittance almost reaches its target value in each field. By this, sufficient image quality is obtained. However, in the liquid crystal display device employing the field sequential system, since the field period is short, the liquid crystal may not respond as intended. That is, the backlight lights up before the transmittance reaches its target value, by which a desired color may not be displayed. As a result, the image quality degrades.

For example, when input gradation data having target gradations such as those shown in FIG. 22 is provided, gradation changes (changes in display gradation) such as those indicated by reference character 91 in FIG. 22 are ideally supposed to occur. However, in the liquid crystal display device employing the field, sequential system, the liquid crystal may not respond as intended and accordingly gradation changes (changes in display gradation) such as those indicated by reference character 92 in FIG. 23 may occur. In such a case, as cam be grasped from FIGS. 22 and 23, the color balance is largely lost, significantly degrading image quality.

In addition, according to the video display device disclosed in Japanese Laid-open Patent Publication No. 2010-250193, although the liquid crystal response time is reduced, since the display order of colors in a frame dynamically changes, flicker occurs.

An object of the present invention is therefore to implement a liquid crystal display device employing a field sequential system and capable of suppressing the degradation of image quality caused by liquid crystal response characteristics.

Means for Solving the Problems

A first aspect of the present invention is directed to a liquid crystal display device employing a field sequential system, the liquid crystal display device performing color display by dividing one frame period into a plurality of fields and rewriting a screen on a field-by-field basis, the liquid crystal display device including:

a liquid crystal panel configured to display an image formed of a plurality of pixels;

a gradation value compressing unit configured to generate compressed data by performing a compression process, the compression process being a process of correcting input gradation data such that a difference between a maximum gradation value and a minimum gradation value is reduced; and a liquid crystal panel driving unit configured to drive the liquid crystal panel based on the compressed data, wherein the gradation value compressing unit performs the compression process such that values of input gradation data of a plurality of colors change at a same ratio, the plurality of colors corresponding to the plurality of fields.

According to a second aspect of the present invention, in the first aspect of the present invention, the gradation value compressing unit determines a value of the compressed data by multiplying a value of the input gradation data by a compression coefficient, the compression coefficient being a value greater than 0 and less than or equal to 1.

According to a third aspect of the present invention, in the second aspect of the present invention, the gradation value compressing unit uses a compression coefficient for all input gradation data upon the compression process, the compression coefficient being set to a constant value less than 1.

According to a fourth aspect of the present invention, in the second aspect of the present invention, the gradation value compressing unit determines the value of the compression coefficient used upon the compression process, depending on a magnitude of the value of the input gradation data.

According to a fifth aspect of the present invention, in the fourth aspect of the present invention, the gradation value compressing unit:

uses a compression coefficient set to a constant value less than 1 upon the compression process, when the value of the input gradation data is less than or equal to a predetermined threshold value; and increases the value of the compression coefficient used upon the compression process as the value of the input gradation data increases, when the value of the input gradation data is greater than the threshold value.

According to a sixth aspect of the present invention, in the fifth aspect of the present invention, the input gradation data includes red input gradation data, green input gradation data, and blue input gradation data, and the gradation value compressing unit:

uses a compression coefficient set to a constant value less than 1 upon the compression process, when an average value of a value of the red input gradation data, a value of the green input gradation data, and a value of the blue input gradation data is less than or equal to the threshold value; and increases the value of the compression coefficient used upon the compression process as the average value increases, when the average value is greater than the threshold value.

According to a seventh aspect of the present invention, in the sixth aspect of the present invention, the gradation value compressing unit sets the value of the compression coefficient used upon the compression process to a value equal to the average value or a value obtained by normalizing the average value, when the average value is greater than the threshold value.

According to an eighth aspect of the present invention, in the sixth aspect of the present invention, when a processing-target pixel for which the value of the compressed data is determined is defined as a target pixel, the gradation value compressing unit determines a compression coefficient used upon a compression process for input gradation data for the target pixel, based on an average value of values of input gradation data for a plurality of pixels including the target pixel and pixels around the target pixel.

According to a ninth aspect of the present invention, in the first aspect of the present invention, the liquid crystal display device further includes a compression process lookup table configured to hold a plurality of input values and a plurality of output values, the plurality of input values being values associated with the input gradation data and values that can be taken by the input gradation data, and the plurality of output values being values associated with the compressed data and values provided to have a one-to-one correspondence with the plurality of input values, wherein the gradation value compressing unit determines a value of the compressed data by referring to the compression process lookup table based on a value of the input gradation data.

According to a tenth aspect of the present invention, in the first aspect of the present invention, one frame period is divided into four fields including a white field in which a white screen is displayed, a red field in which a red screen is displayed, a green field in which a green screen is displayed, and a blue field in which a blue screen is displayed.

According to an eleventh aspect of the present invention, in the first aspect of the present invention, the liquid crystal display device further includes an overdrive correcting unit configured to perform correction that emphasizes a temporal change of the compressed data that is generated by the gradation value compressing unit.

A twelfth aspect of the present invention is directed to a method for driving a liquid crystal display device employing a field sequential system, the liquid crystal display device including a liquid crystal panel displaying an image formed of a plurality of pixels and configured to perform color display by dividing one frame period into a plurality of fields and rewriting a screen on a field-by-field basis, the method including:

a gradation value compressing step of generating compressed data by performing a compression process, the compression process being a process of correcting input gradation data such that a difference between a maximum gradation value and a minimum gradation value is reduced; and a liquid crystal panel driving step of driving the liquid crystal panel based on the compressed data, wherein in the gradation value compressing step, the compression process is performed such that values of input gradation data of a plurality of colors change at a same ratio, the plurality of colors corresponding to the plurality of fields.

EFFECTS OF THE INVENTION

According to the first aspect of the present invention, a liquid crystal display device is provided with a gradation value compressing unit that performs a compression process (a process of correcting input gradation data such that a difference between a maximum gradation value and a minimum gradation value is reduced) on input gradation data. Hence, a gradation difference between two consecutive fields becomes smaller than the original one. By this, the liquid crystal response time in each field is reduced. In addition, in the compression process, the values of input gradation data of a plurality of colors change at the same ratio. Hence, although the lightness of a color to be displayed decreases, the hue and the saturation do not change. Therefore, color balance is not impaired by the compression process. By the above, a liquid crystal display device employing a field sequential system is implemented that is capable of suppressing the degradation of image quality caused by liquid crystal response characteristics.

According to the second aspect of the present invention, the value of input gradation data can be compressed without performing a complex process.

According to the third aspect of the present invention, by providing a gradation value compressing unit with a simple configuration, the same effects as those of the first aspect of the present invention can be obtained.

According to the fourth aspect of the present invention, it is possible to make the degree of compression upon a compression process smaller as a value (gradation value) of input gradation data is larger. By this, the process can be controlled such that the gradation value does not change before and after the compression process for data with the maximum gradation. By such control, the maximum luminance does not decrease before and after the compression process. By the above, a liquid crystal display device employing the field sequential system is implemented that is capable of suppressing the degradation of image quality caused by liquid crystal response characteristics, without reducing the maximum luminance.

According to the fifth aspect of the present invention, as in the fourth aspect of the present invention, a liquid crystal display device employing the field sequential system is implemented that is capable of suppressing the degradation of image quality caused by liquid crystal response characteristics, without reducing the maximum luminance.

According to the sixth aspect of the present invention, as in the fourth aspect of the present invention, a liquid crystal display device employing the field sequential system is implemented that is capable of suppressing the degradation of image quality caused by liquid crystal response characteristics, without reducing the maximum luminance.

According to the seventh aspect of the present invention, as in the fourth aspect of the present invention, a liquid crystal display device employing the field sequential system is implemented that is capable of suppressing the degradation of image quality caused by liquid crystal response characteristics, without reducing the maximum luminance.

According to the eighth aspect of the present invention, the value of a compression coefficient used upon a compression process for input gradation data for a given pixel is determined based on an average value of the values of input gradation data for a plurality of pixels including the pixel and pixels therearound. Hence, the value of the compression coefficient is prevented from greatly changing between adjacent pixels. Therefore, an image with a smooth color change is displayed. By the above, a liquid crystal display device employing the field sequential system is implemented that is capable of suppressing the degradation of image quality caused by liquid crystal response characteristics, without reducing the maximum luminance, and capable of obtaining a displayed image with a smooth color change.

According to the ninth aspect of the present invention, the value of input gradation data can be compressed without performing a computation process.

According to the tenth aspect of the present invention, one frame period includes a white field in which color mixture components of three primary colors are displayed, in addition to three fields in which single-color display of each of the three primary colors is performed. Hence, the occurrence of color breakup is suppressed. By the above, a liquid crystal display device employing the field sequential system is implemented that is capable of suppressing the occurrence of color breakup and suppressing the degradation of image quality caused by liquid crystal response characteristics.

According to the eleventh aspect of the present invention, the liquid crystal response time is more effectively reduced.

According to the twelfth aspect of the present invention, the same effects as those of the first aspect of the present invention can be provided in a method for driving a liquid crystal display device employing the field sequential system.

BRIEF DESCRIPTION OF THE DRAWINGS

FIG. 11 is a diagram showing an example of a compression process lookup table in a variant of the first embodiment.

MODES FOR CARRYING OUT THE INVENTION

Embodiments of the present invention will be described below with reference to the accompanying drawings. Mote that it is assumed that a liquid crystal display device according to each embodiment can perform 256 gradation display.

<1. First Embodiment>

<1.1 Overall Configuration and Overview of Operations>

Figure 2:
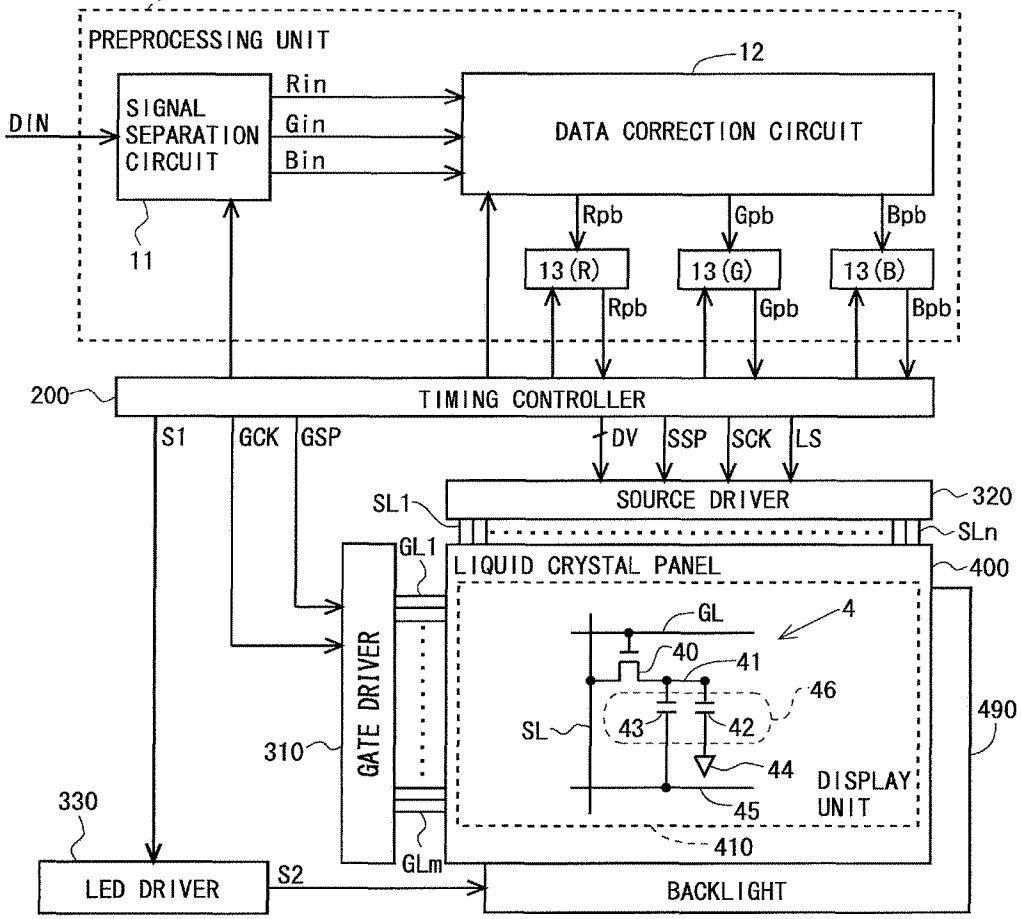
FIG. 2 is a block diagram showing an overall configuration of the liquid crystal display device in the first embodiment.

FIG. 2 is a block diagram showing an overall configuration of a liquid crystal display device according to a first embodiment of the present invention. The liquid crystal display device is composed of a preprocessing unit 100, a timing controller 200, a gate driver 310, a source driver 320, an LED driver 330, a liquid crystal panel 400, and a backlight 490. Note that one or both the gate driver 310 and the source driver 320 may be provided in the liquid crystal panel 400. The liquid crystal panel 400 includes a display unit 410 for displaying an image. The preprocessing unit 100 includes a signal separation circuit 11, a data correction circuit 12, a red field memory 13(R), a green field memory 13(G), and a blue field memory 13(B). Light-emitting diodes (LEDs) are adopted as the light sources of the backlight 490. Specifically, the backlight 490 is composed of a red LED, a green LED, and a blue LED. Note that, in the present embodiment, a liquid crystal panel driving unit is implemented by the timing controller 200, the gate driver 310, and the source driver 320.

Figure 3:
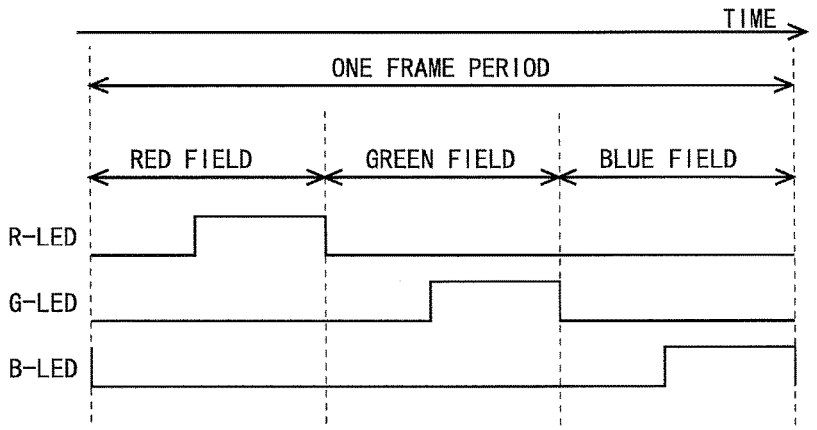
FIG. 3 is a diagram showing a configuration of one frame period in the first embodiment.

The liquid crystal display device according to the present embodiment adopts a field sequential system. FIG. 3 is a diagram showing a configuration of one frame period in the present embodiment. One frame period is divided into a red field in which a red screen is displayed based on a red component of an input image signal DIN; a green field in which a green screen is displayed based on a green component of the input image signal DIN; and a blue field in which a blue screen is displayed based on a blue component of the input image signal DIN. In the red field, the red LED goes into a light-on state after a lapse of a predetermined period from the start time point of the field. In the green field, the green LED goes into a light-on state after a lapse of a predetermined period from the start time point of the field. In the blue field, the blue LED goes into a light-on state after a lapse of a predetermined period from the start time point of the field. During the operation of the liquid crystal display device, these red, green, and blue fields are repeated. By this, a red screen, a green screen, and a blue screen are repeatedly displayed, and a desired color image is displayed on the display unit 410. Note that the order of fields is not particularly limited. The order of fields may be, for example, the order "a blue field, a green field, and a red field." In addition, the length of a period during which the LED is bought into a light-on state in each field may be set taking into account liquid crystal response characteristics.

As for FIG. 2, a plurality of (n) source bus lines (video signal lines) SL1 to SLn and a plurality of (m) gate bus lines (scanning signal lines) GL1 to GLm are disposed in the display unit 410. A pixel formation portion 4 which forms a pixel is provided at a corresponding intersection of the source bus lines SL1 to SLn and the gate bus lines GL1 to GLm. That is, the display unit 410 includes a plurality of (n×m) pixel formation portions 4. The plurality of pixel formation portions 4 are arranged in a matrix form and thereby form a pixel matrix of m rows×n columns. Each pixel formation portion 4 includes a thin-film transistor (TFT) 40 which is a switching element having a gate terminal connected to a gate bus line GL passing through a corresponding intersection, and a source terminal connected to a source bus line SL passing through the intersection; a pixel electrode 41 connected to a drain terminal of the TFT 40; a common electrode 44 and an auxiliary capacitance electrode 45 which are provided so as to be shared by the plurality of pixel formation portions 4; a liquid crystal capacitance 42 formed of the pixel electrode 41 and the common electrode 44; and an auxiliary capacitance 43 formed of the pixel electrode 41 and the auxiliary capacitance electrode 45. A pixel capacitance 46 is composed of the liquid crystal capacitance 42 and the auxiliary capacitance 43. Note that components corresponding to only one pixel formation portion 4 are shown in the display unit 410 in FIG. 2.

Meanwhile, as the TFTs 40 in the display unit 410, for example, an oxide TFT (a thin-film transistor using an oxide semiconductor as a channel layer) can be adopted. More specifically, a TFT whose channel layer is formed of In—Ga—Zn—O (indium gallium zinc oxide) that is an oxide semiconductor containing indium (In), gallium (Ga), zinc (Zn), and oxygen (O) as the main components (such a TFT is hereinafter referred to as "In—Ga—Zn—O-TFT") can be adopted as the TFT 40. By adopting such an In—Ga—Zn—O-TFT, the effects of an improvement in definition and a reduction in power consumption can be obtained, and in addition, the writing speed can be increased over conventional cases. Moreover, it is also possible to adopt a transistor using, as a channel layer, an oxide semiconductor other than In—Ga—Zn—O (indium gallium zinc oxide). The same effects are obtained also when a transistor using an oxide semiconductor containing, for example, at least one of indium, gallium, zinc, copper (Cu), silicon (Si), tin (Sn), aluminum (Al), calcium (Ca), germanium (Ge), and lead (Pb) as the channel layer is adopted. Note that the present invention does not intend to exclude the use of other TFTs than oxide TFTs.

Next, the operation of the components shown in FIG. 2 will be described. The signal separation circuit 11 in the preprocessing unit 100 separates an input image signal DIN transmitted from an external source into red input gradation data Rin, green input gradation data Gin, and blue input gradation data Bin.

The data correction circuit 12 in the preprocessing unit 100 performs a compression process which will be described later and a correction process for overdrive, on the input gradation data (the red input gradation data Rin, the green input gradation data Gin, and the blue input gradation data Bin) outputted from the signal separation circuit 11, and outputs compressed data obtained in those processes (compressed data Rpb for a red field, compressed data Gpb for a green field, and compressed data Bpb for a blue field). Note that a detailed description about the data correction circuit 12 will be made later.

The red field memory 13(R), the green field memory 13(G), and the blue field memory 13(B) respectively store the compressed data Rpb for a red field, compressed data Gpb for a green field, and compressed data Bpb for a blue field which are outputted from the data correction circuit 12.

The timing controller 200 reads the compressed data Rpb for a red field, the compressed data Gpb for a green field, and the compressed data Bpb for a blue field from the red field memory 13(R), the green field memory 13(G), and the blue field memory 13(B), respectively, and outputs digital video signals DV, a gate start pulse signal GSP and a gate clock signal GCK which are for controlling the operation of the gate driver 310, a source start pulse signal SSP, a source clock signal SCK, and a latch strobe signal LS which are for controlling the operation of the source driver 320, and an LED driver control signal S1 for controlling the operation of the LED driver 330.

The gate driver 310 repeats the application of an active scanning signal to each gate bus line GL with one vertical scanning period as a cycle, based on the gate start pulse signal GSP and gate clock signal GCK which are transmitted from the timing controller 200.

The source driver 320 receives the digital video signals DV, source start pulse signal SSP, source clock signal SCK, and latch strobe signal LS which are transmitted from the timing controller 200, and applies a driving video signal to each source bus line SL. At this time, the source driver 320 sequentially holds a digital video signal DV indicating a voltage to be applied to each source bus line SL, at timing at which a pulse of the source clock signal SCK occurs. Then, the held digital video signals DV are converted into analog voltages at timing at which a pulse of the latch strobe signal LS occurs. The converted analog voltages are simultaneously applied to all source bus lines SL1 to SLn, as driving video signals.

The LED driver 330 outputs a light source control signal S2 for controlling the state of each LED forming the backlight 490, based on the LED driver control signal S1 transmitted from the timing controller 200. In the backlight 490, switching of the state of each LED (switching between a light-on state and a light-off state) is performed as appropriate, based on the light source control signal S2. Note that, in the present embodiment, the state of each LED is switched as shown in FIG. 3.

In the above-described manner, scanning signals are applied to the gate bus lines GL1 to GLm, driving video signals are applied to the source bus lines SL1 to SLn, and the state of each LED is switched as appropriate, by which an image corresponding to the input image signal DIN (an image formed of a plurality of pixels) is displayed on the display unit 410 of the liquid crystal panel 400.

<1.2 Data Correction Circuit>

Figure 4:
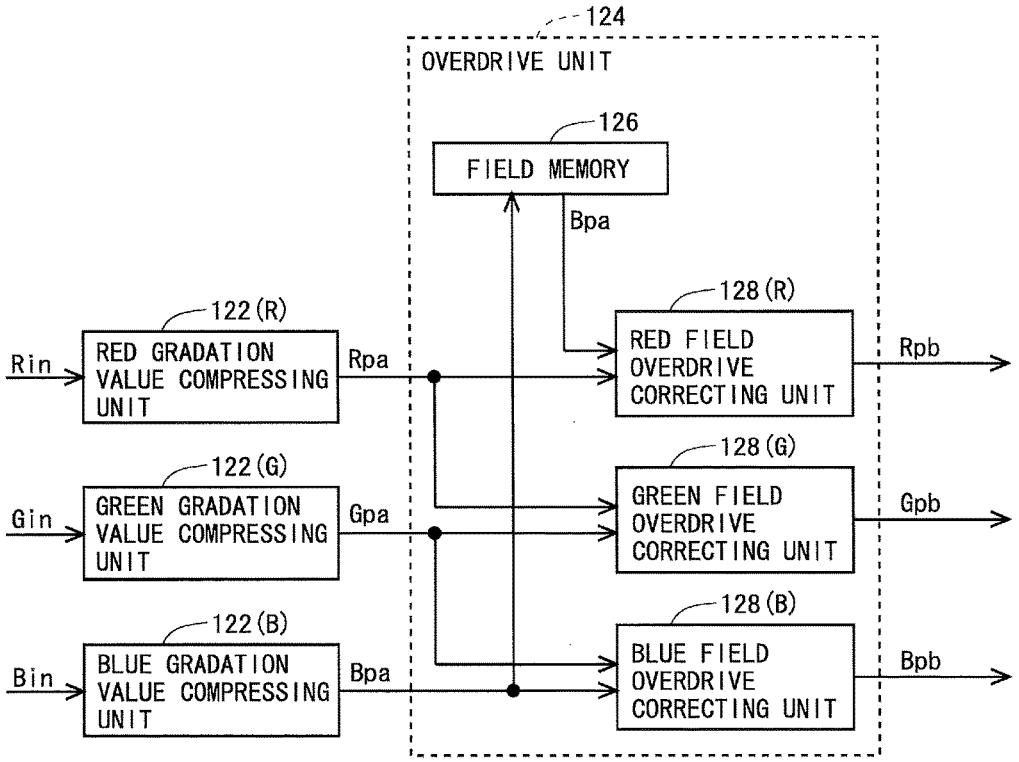
FIG. 4 is a block diagram showing a configuration of a data correction circuit in the first embodiment.

Next, the configuration and operation of the data correction circuit 12 will be described in detail. FIG. 4 is a block diagram showing a configuration of the data correction circuit 12 in the present embodiment. The data correction circuit 12 is composed of a red gradation value compressing unit 122(R), a green gradation value compressing unit 122(G), a blue gradation value compressing unit 122(B), and an overdrive unit 124. The overdrive unit 124 includes a field memory 126, a red field overdrive correcting unit 128(R), a green field overdrive correcting unit 128(G), and a blue field overdrive correcting unit 128(B). Note that in the following the red gradation value compressing unit 122(R), the green gradation value compressing unit 122(G), and the blue gradation value compressing unit 122(B) are also collectively and simply referred to as "gradation value compressing unit." The gradation value compressing unit is denoted by reference character 122. Note also that the red field overdrive correcting unit 128(R), the green field overdrive correcting unit 128(G), and the blue field overdrive correcting unit 128(B) are also collectively and simply referred to as "overdrive correcting unit." The overdrive correcting unit is denoted by reference character 128.

<1.2.1 Gradation Value Compressing Unit>

The gradation value compressing unit 122 performs a compression process that corrects input gradation data such that a difference between a maximum gradation value and a minimum gradation value is reduced, in order to reduce the liquid crystal response time in each field. Then, the gradation value compressing unit 122 outputs data obtained in the compression process, as compressed data. Regarding the compression process, more specifically, a process of multiplying a gradation value of input gradation data by a compression coefficient which is a constant less than 1 is performed in the present embodiment. Specifically, a compression coefficient K is set so as to satisfy the following equation (1), and a gradation value Dout of compressed data is calculated by the following equation (2) based on the compression coefficient K and a gradation value Din of input gradation data:

$$0<K<1 \tag{1}$$

$$Dout-Din\times K \tag{2}$$

Figure 1:
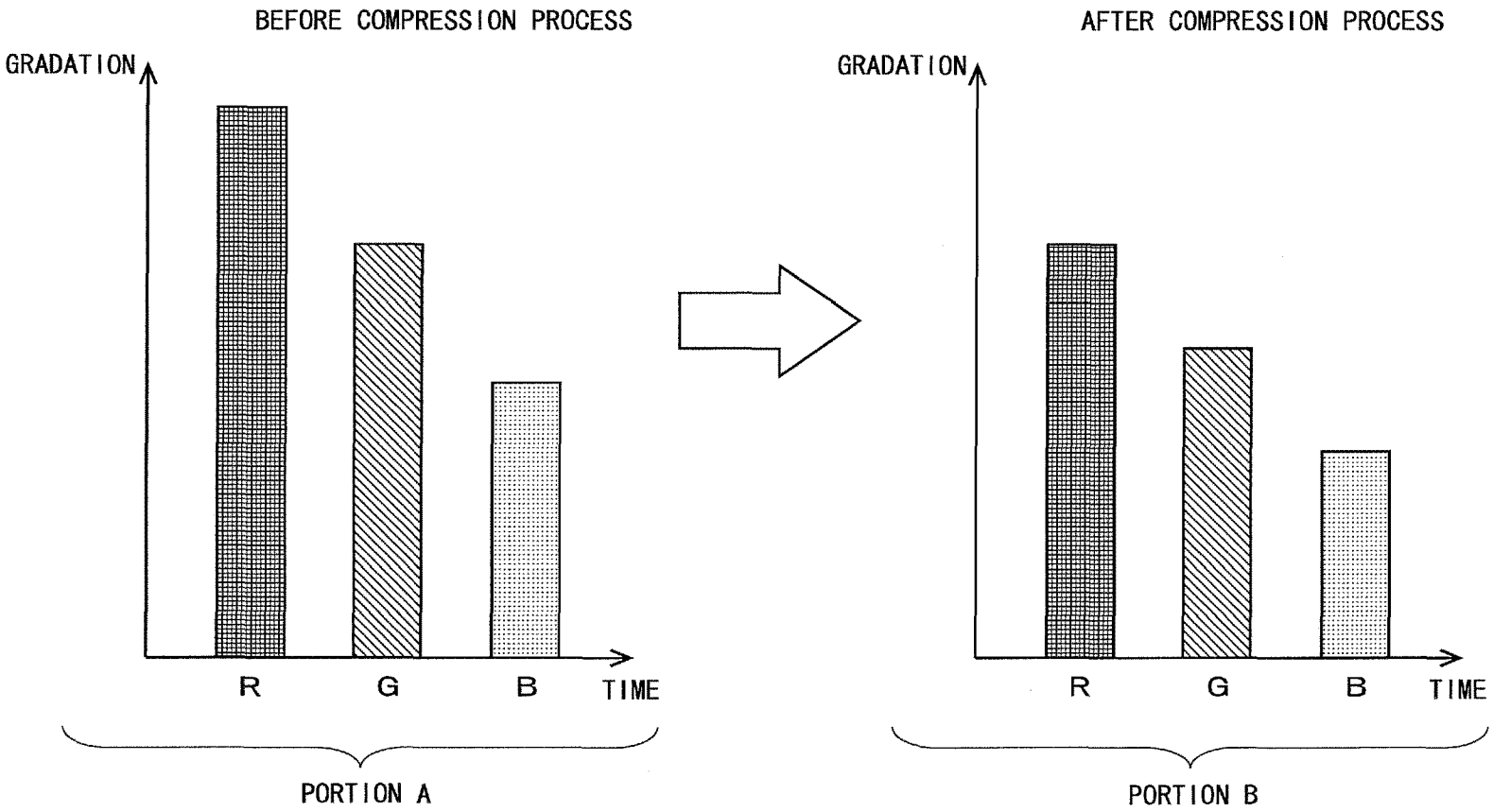
FIG. 1 is a diagram for describing a compression process in a liquid crystal display device according to a first embodiment of the present invention.

The compression coefficient K is determined within a range satisfying the above equation (1), based on the liquid crystal response characteristics, display quality required for the liquid crystal display device, etc. For example, when the compression coefficient is set to 0.75, input gradation data with a gradation value of 200 is converted, by this compression process, into compressed data with a gradation value of 150. In addition, for example, when the compression coefficient is set to 0.9, input gradation data with a gradation value of 100 is converted, by this compression process, into compressed data with a gradation value of 90. By performing such a compression process for each color, input gradation data having gradation values such as those shown in portion A of FIG. 1 is converted into compressed data having gradation values such as those shown in portion B of FIG. 1.

In the above-described manner, the red gradation value compressing unit 122(R) generates and outputs red compressed data Rpa based on red input gradation data Rin, the green gradation value compressing unit 122(G) generates and outputs green compressed data Gpa based on green input gradation data Gin, and the blue gradation value compressing unit 122(B) generates and outputs blue compressed data Bpa based on blue input gradation data Bin.

<1.2.2 Overdrive Unit>

The field memory 126 holds, for one frame period, the blue compressed data Bpa outputted from the blue gradation value compressing unit 122(B) corresponding to a blue field which is the last field of one frame period. Blue compressed data Bpa stored in the field memory 126 in each frame is used in the next frame by the reel field overdrive correcting unit 128(R).

Figures 5, 6:
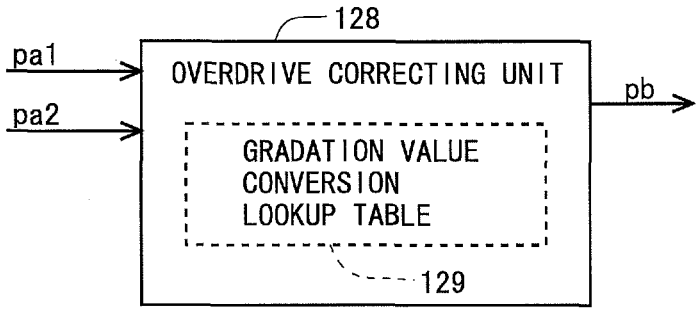
FIG. 5 is a diagram for describing an overdrive correcting unit in the first embodiment.
FIG. 6 is a diagram showing an example of a gradation value conversion lookup table in the first embodiment.

FIG. 5 is a diagram for describing an overdrive correcting unit 128. The overdrive correcting unit 128 includes a gradation value conversion lookup table 129 which will be described later. Compressed data pa1 for the previous field and compressed data pa2 for display field (current field) are inputted to the overdrive correcting unit 128. Note that in the following the value (gradation value) of the compressed data pa1 for the previous field is referred to as "previous-field value" and the value (gradation value) of the compressed data pa2 for the display field is referred to as "display-field value." The overdrive correcting unit 128 determines an output value corresponding to a combination of the previous-field value and the display-field value, based on the gradation value conversion lookup table 129. The output value determined based on the gradation value conversion lookup table 129 is outputted as compressed data pb from the overdrive correcting unit 128.

Note that the corn-pressed data pa1 and pa2 in FIG. 5 correspond to any of the compressed data Rpa, Gpa, and Bpa in FIG. 4, and the compressed data pb in FIG. 5 corresponds to any of compressed data Rpb, Gpb, and Bpb in FIG. 4.

FIG. 6 is a diagram showing an example of the gradation value conversion lookup table 129. In FIG. 6, numerical values shown in the leftmost column indicate previous-field values, and numerical values shown in the uppermost row indicate display-field values. In addition, a numerical value shown at a position at which each row and each column intersect indicates a gradation value (output value) corresponding to a drive voltage which is determined based on a combination of a previous-field value and a display-field value. For example, when the previous-field value is "128" and the display-field value is "192", the output value is "210." In addition, for example, when the previous-field value is "128" and the display-field value is "32", the output value is "25." As such, the output values in the gradation value conversion lookup table 129 are set such that compressed data generated by the gradation value compressing unit 122 is corrected to emphasize a temporal change of data value (gradation value). Note that the values stored in the gradation value conversion lookup table 129 are values appropriate to the pre-measured response characteristics of an adopted liquid crystal panel.

In the above-described manner, the red field overdrive correcting unit 128(R) generates and outputs compressed data Rpb for a red field which is used to drive the liquid crystal panel 400, based on the blue compressed data Bpa for the previous frame and the red compressed data Rpa, the green field overdrive correcting unit 128(G) generates and outputs compressed data Gpb for a green field which is used to drive the liquid crystal panel 400, based on the green compressed data Gpa and the red compressed data Rpa, and the blue field overdrive correcting unit 128(B) generates and outputs compressed data Bpb for a blue field which is used to drive the liquid crystal panel 400, based on the blue compressed data Bpa and the green compressed data Gpa.

Meanwhile, the gradation value conversion lookup table 129 shown in FIG. 6 stores only nine gradation values among 256 gradation values, as previous-field values and display-field values. That is, the gradation value conversion lookup table 129 stores, as output values, only values corresponding to combinations of some of all gradation values that can be represented by the liquid crystal panel 400. Hence, for example, when the previous-field value is "48" and the display-field value is "140", an output value cannot be directly determined from the gradation value conversion lookup table 129. In such a case, the output value for the previous-field value "48" and the display-field value "140" is determined by an interpolation computation performed based on an output value for the previous-field value "32" and the display-field value "128", an output value for the previous-field value "32" and the display-field value "160", an output value for the previous-field value "64" and the display-field value "128", and an output value for the previous-field value "64" and the display-field value "160."

Note that if an increase in memory capacity is allowed, then all gradation values that can be represented by the liquid crystal panel 400 may be stored in the gradation value conversion lookup table 129, as previous-field values and display-field values. According to this configuration, although the capacity of a memory to be mounted on the liquid crystal display device increases, errors caused by an interpolation computation do not occur.

Moreover, the configuration of the overdrive unit 124 shown here (see FIG. 4) is an example and the present invention is not limited thereto. For example, a liquid crystal display device that mainly displays still images does not necessarily need to be provided with the field memory 126.

<1.3 Effects>

Figure 7:
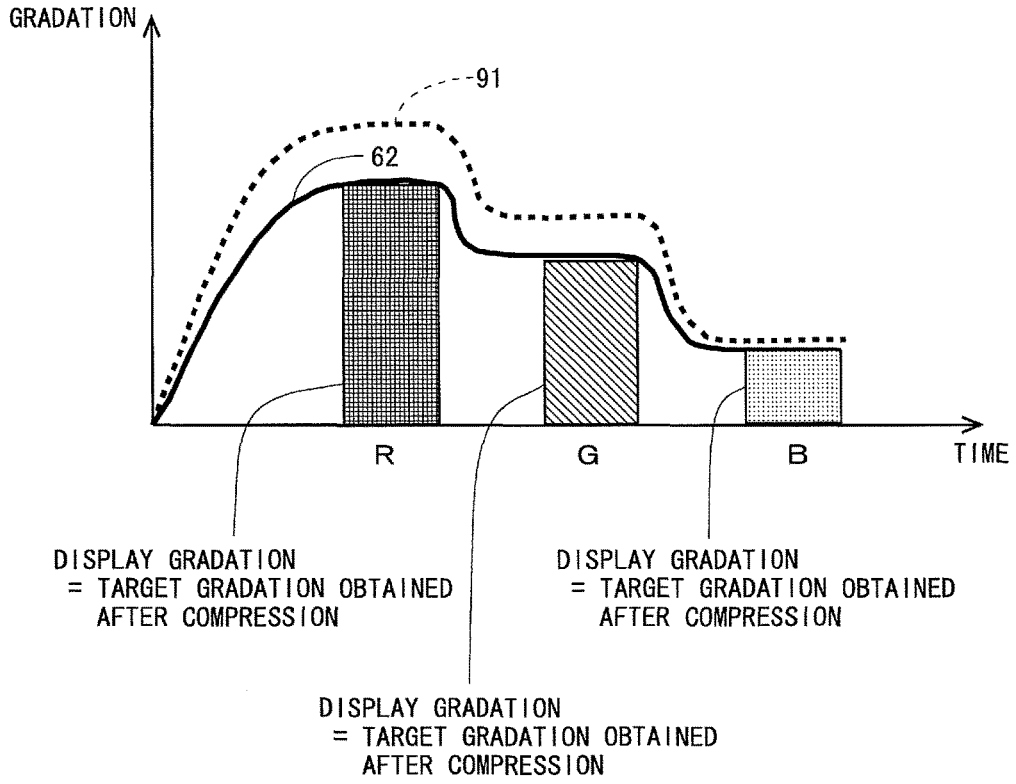
FIG. 7 is a diagram for describing an effect in the first embodiment.
Figure 22:
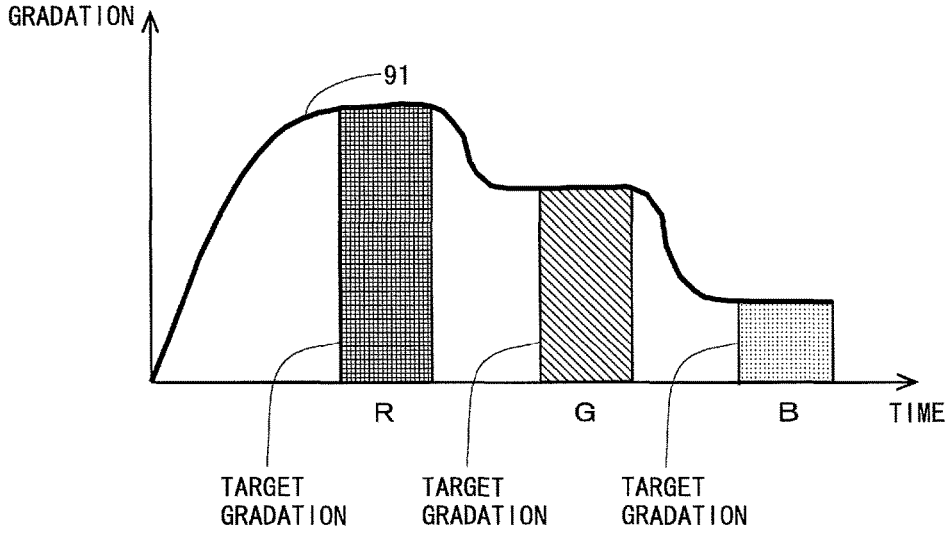
FIG. 22 is a diagram for describing a conventional example.
Figure 23:
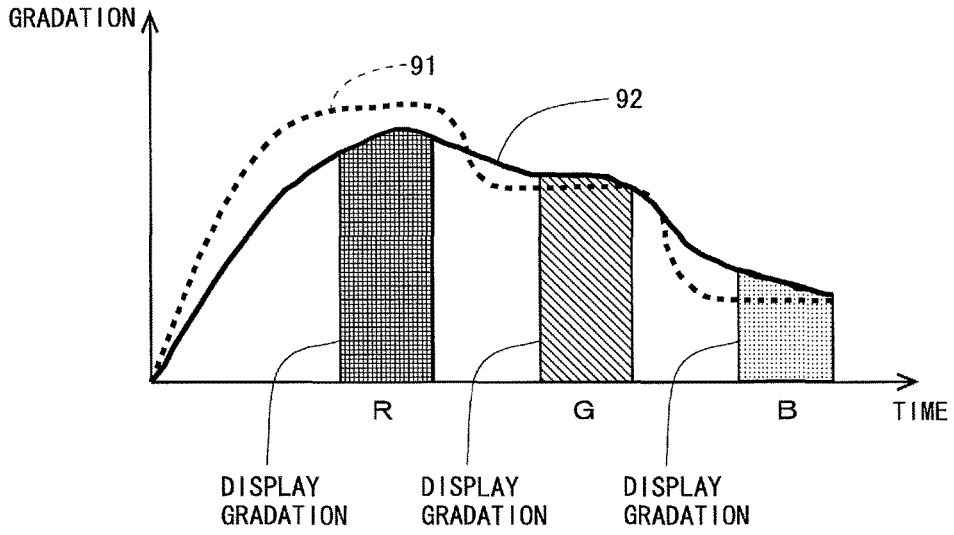
FIG. 23 is a diagram for describing the conventional example.

The liquid crystal display device employing a field sequential system according to the present embodiment is provided with the gradation value compressing unit 122 that performs a compression process (a process of reducing a gradation value) on input gradation data. The gradation values of all input gradation data are compressed at a certain ratio by this compression process. Hence, the gradation values of all input gradation data are reduced at a certain ratio. Therefore, a gradation difference between two consecutive fields becomes smaller than the original one. By this, the liquid crystal response time (a period of time from the start time point of a field until the transmittance reaches its target value) in each field is reduced. For example, when input gradation data having gradation values such as those shown in FIG. 22 is provided, conventionally, gradation changes such as those indicated by reference character 92 in FIG. 23 occur, degrading image quality. On the other hand, in the present embodiment, when input gradation data having target gradations such as those shown in FIG. 22 is provided, gradation changes depending on target gradations obtained after a compression process occur as indicated by reference character 62 in FIG. 7.

Figure 8:
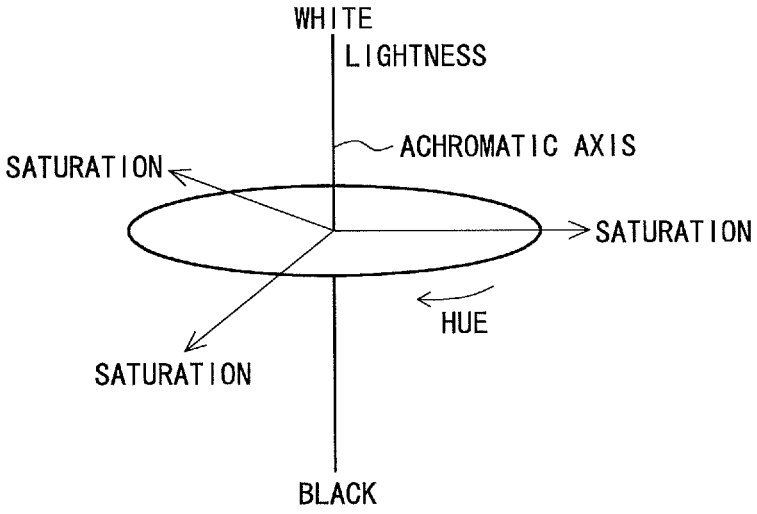
FIG. 8 is a diagram for describing three psychological attributes of color.
Figure 9:
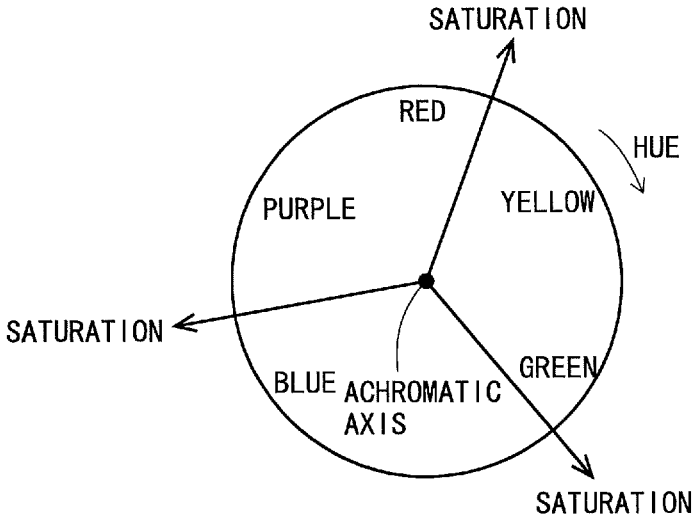
FIG. 9 is a diagram for describing the three psychological attributes of color.

Meanwhile, according to the present embodiment, since gradation values are compressed, an original target image is not displayed. However, a feeling of strangeness given to a viewer is a little. The reason therefor will be described below. In general, it is known that color has the elements "hue", "lightness", and "saturation" which are called three psychological attributes. The hue is a color shade such as "red . . . yellow . . . green . . . blue . . . purple." The lightness is the degree of brightness of color. The saturation is the degree of color vividness. These three psychological attributes are generally represented as shown in FIG. 8. In FIG. 8, the lightness is shown in a vertical direction, and a vertical line represents an achromatic axis. The higher the position on the achromatic axis the higher the lightness, and the lower the position on the achromatic axis the lower the lightness. Also, the greater the distance from the achromatic axis, the higher the saturation. The hue is represented by the circumference in which there is the achromatic axis at the center. As shown in FIG. 9, colors such as "red . . . yellow . . . green . . . blue . . . purple" are present around the achromatic axis. As described above, the hue represents a color shade, and the saturation represents the color vividness. On the other hand, the lightness merely represents the brightness of color. Therefore, it is considered that an impression a person gets from, a displayed image greatly changes when the hue or the saturation changes rather than when the lightness changes. In this regard, in the present embodiment, overall gradation values are reduced by a gradation value compression process without changing the ratio of RGB gradation values (red gradation value: green gradation value: blue gradation value). That is, although the lightness of a color to be displayed decreases, the hue or the saturation do not change, by the compression process. Therefore, a feeling of strangeness a viewer gets from a displayed image which is obtained after a compression process is a little. As such, it becomes possible to display a color such that the liquid crystal responds as intended in each field without impairing color balance.

Figure 10:
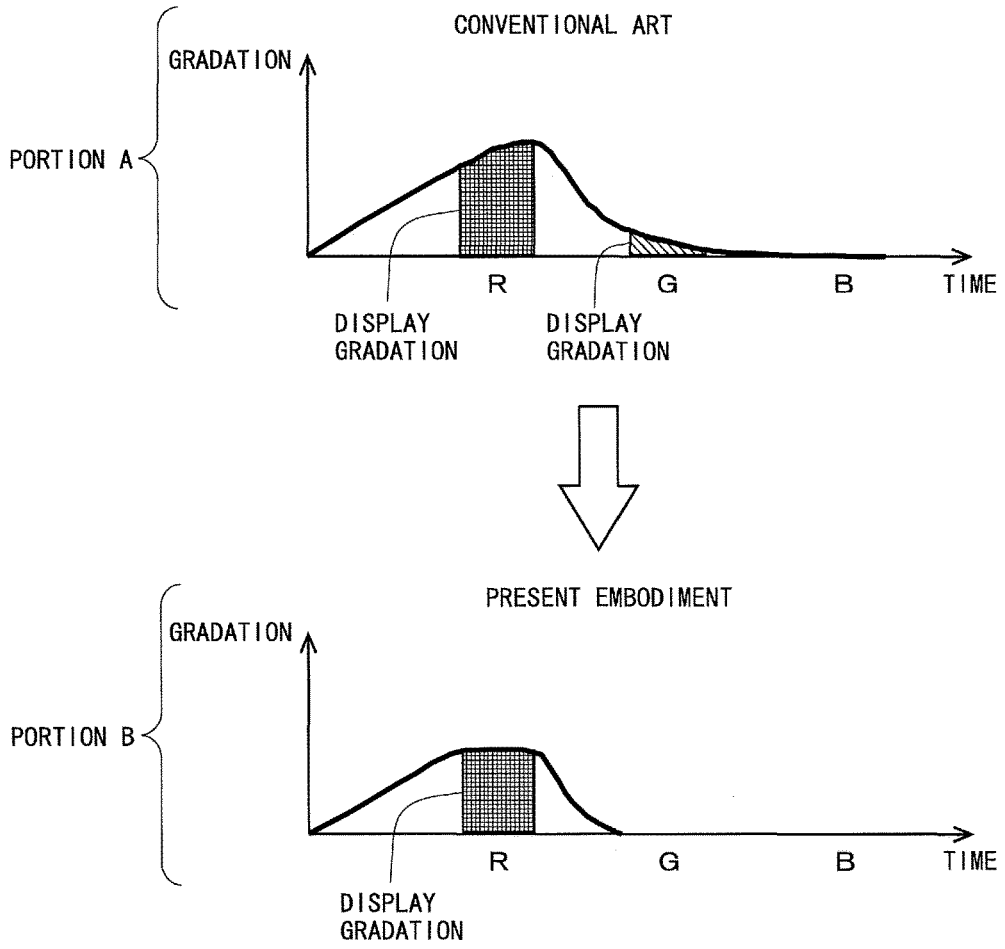
FIG. 10 is a diagram for describing an effect in the first-embodiment.

In addition, when single-color display is performed, the aperture ratio of the liquid crystal is smaller than the original one, and thus, the occurrence of a color mixture between two adjacent fields is suppressed. For example, when red single-color display is performed, according to conventional art, a color mixture of red and green may occur as shown in portion A of FIG. 10. Regarding this, according to the present embodiment, the liquid crystal quickly responds to a state in which the transmittance corresponding to a gradation value of 0 is obtained in a green field as shown in portion B of FIG. 10. As such, in the present embodiment, the occurrence of a color mixture upon single-color display is suppressed.

Furthermore, in the present embodiment, overdrive is adopted. Hence, the liquid crystal response time is more effectively reduced.

As described above, according to the present embodiment, a liquid crystal display device employing a field sequential system, is implemented that is capable of suppressing the degradation of image quality caused by liquid crystal response characteristics.

<1.4 Variant>

In the above-described first embodiment, the value (gradation value) of compressed data is determined by performing computation using the compression coefficient K; however, the present invention is not limited thereto. The value of compressed data can also be determined by referring to a lookup table without performing computation, which will be described below.

A liquid crystal display device according to the present variant includes a lookup table (hereinafter, referred to as "compression process lookup table") 140 such as that shown in FIG. 11. The compression process lookup table 140 holds a plurality of input values that can be taken by input gradation data (red input gradation data Rin, green input gradation data Gin, and blue input gradation data Bin); and a plurality of output values having a one-to-one correspondence with the plurality of input values. The input values in the compression process lookup table 140 are associated with the input gradation data, and the output values in the compression process lookup table 140 are associated with compressed data.

In a configuration provided with the compression process lookup table 140 such as that described above, a gradation value compressing unit 122 determines the value of compressed data by referring to the compression process lookup table 140 based on the value of input gradation data. For example, according to the compression process lookup table 140 shown in FIG. 11, when the value of input gradation data is "128", the value of compressed data is "115", and when the value of input gradation data is "253", the value of compressed data is "228".

<2. Second Embodiment>

<2.1 Overview>

Figure 12:
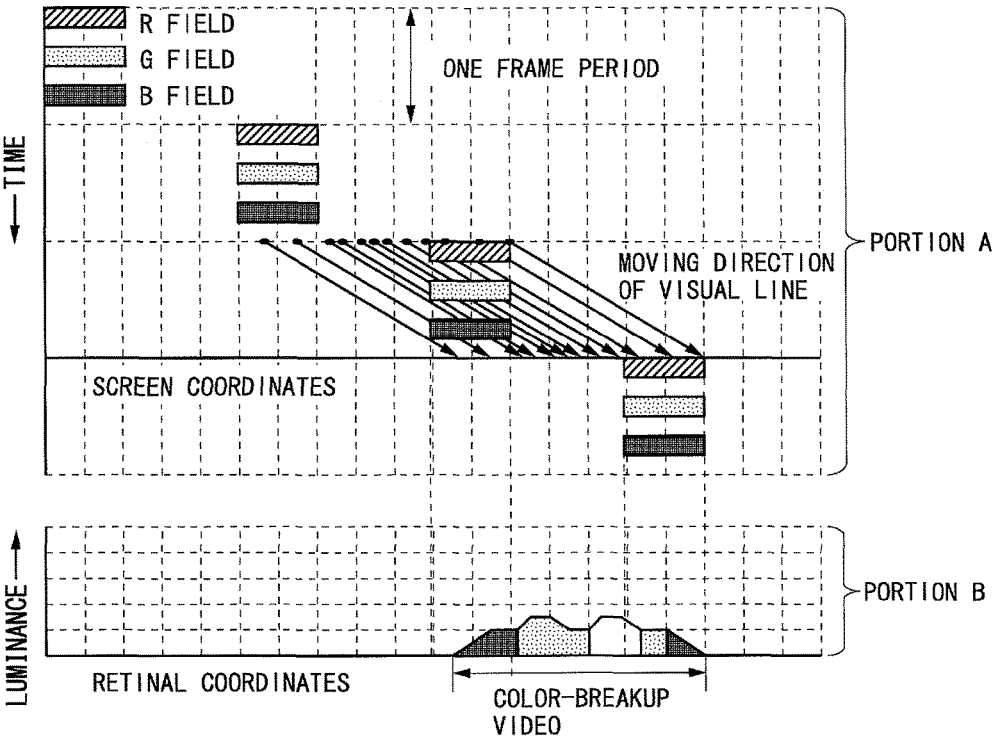
FIG. 12 is a diagram showing the principle of occurrence of color breakup.

As for the liquid crystal display device employing the field sequential system, there is conventionally known a problem of occurrence of color breakup. FIG. 12 is a diagram showing the principle of occurrence of color breakup. In portion A of FIG. 12, a vertical axis represents time and a horizontal axis represents a position on a screen. In general, when an object moves within a display screen, the visual line of the observer follows the object and moves in a moving direction of the object. For example, in an example shown in FIG. 12, when a white object moves from left to right within the display screen, the visual line of the observer moves in a direction of oblique arrows. On the other hand, when three field images of R, G, and B are extracted from a video image at the same moment, the position of the object in each field image is the same. Hence, as shown in portion B of FIG. 12, color breakup occurs in a video image reflected on the retina. As measures against such color breakup, there has been made a proposal for providing in one frame period a field that displays a color not being any of the three primary colors, that is, a field for performing display with at least two colors (mixed-color display). Specifically, by providing a white field that displays a white screen in one frame period, the occurrence of color breakup is effectively suppressed. Hence, in the present embodiment, a white field is provided in one frame period.

Figure 13:
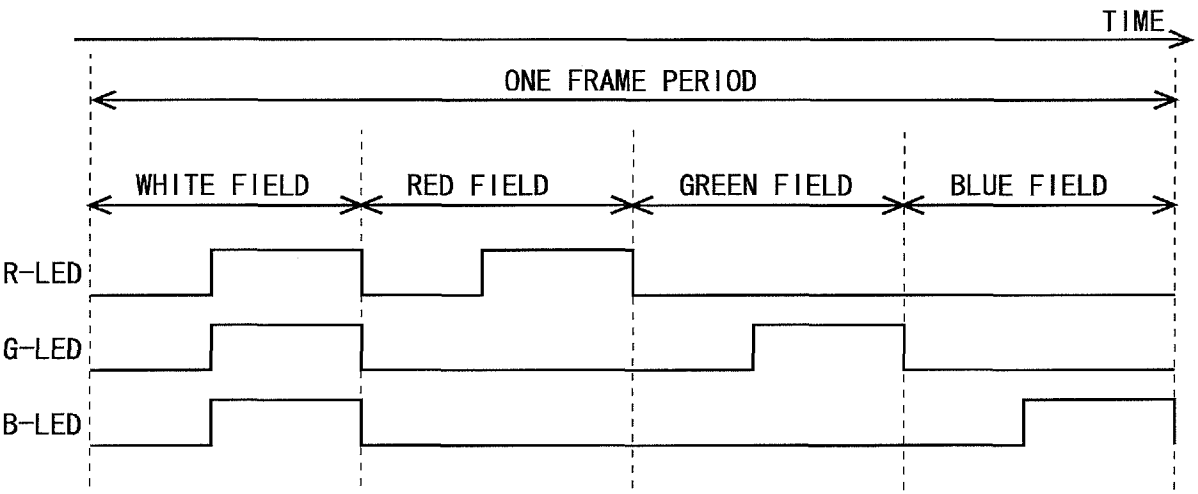
FIG. 13 is a diagram showing a configuration of one frame period in a liquid crystal display device according to a second embodiment of the present invention.

FIG. 13 is a diagram showing a configuration of one frame period in the present embodiment. As shown in FIG. 13, in the present embodiment, one frame period is divided into a white field, a red field, a green field, and a blue field. In the white field, the red LED, the green LED, and the blue LED go into a light-on state after a lapse of a predetermined period from the start time point of the field. In the red field, the red LED goes into a light-on state after a lapse of a predetermined period from the start time point of the field. In the green field, the green LED goes into a light-on state after a lapse of a predetermined period from the start time point of the field. In the blue field, the blue LED goes into a light-on state after a lapse of a predetermined period from the start time point of the field. During the operation of the liquid crystal display device, these white, red, green, and blue fields are repeated. By this, a white screen, a red screen, a green screen, and a blue screen are repeatedly displayed, and a desired color image is displayed on the display unit 410. Note that the order of fields is not particularly limited. The order of fields may be, for example, the order "a white field, a blue field, a green field, and a red field." As described above, in the present embodiment, each frame includes a white field in addition to a red field, a green field, and a blue field.

<2.2 Configuration, etc.>

Figure 14:
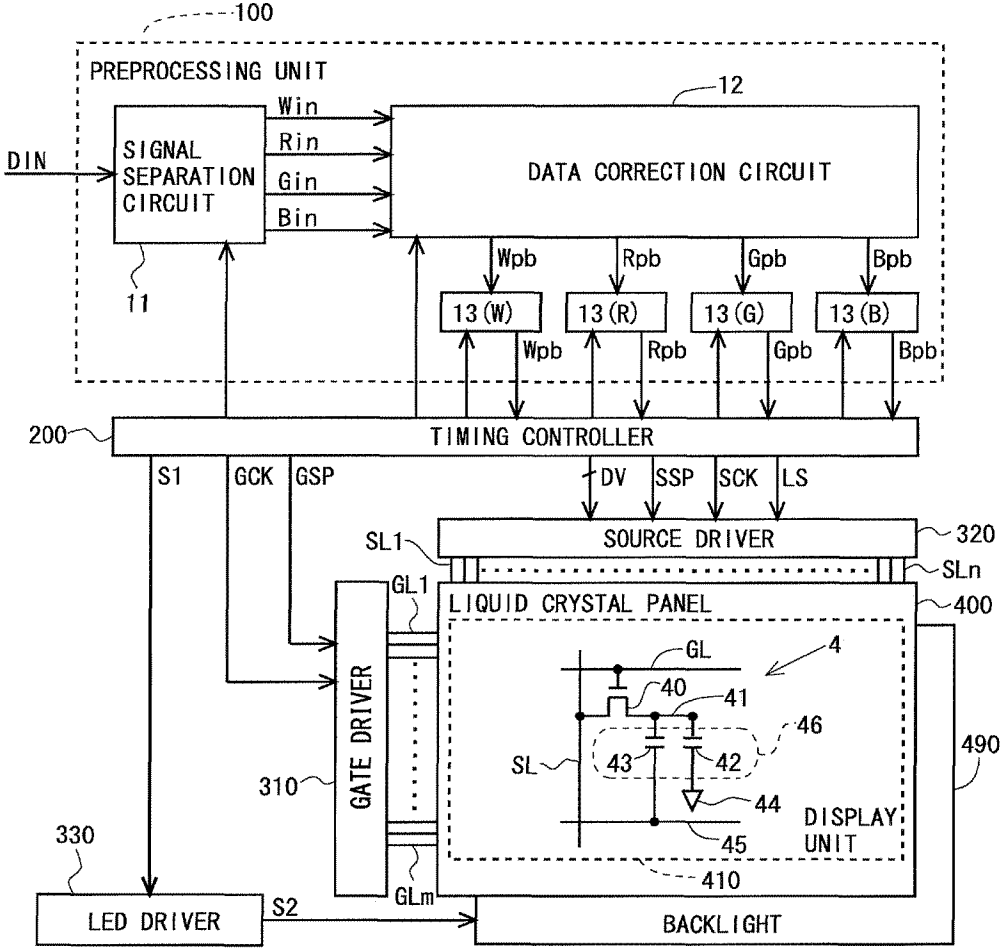
FIG. 14 is a block diagram showing an overall configuration of the liquid crystal display device in the second embodiment.

FIG. 14 is a block diagram showing an overall configuration of a liquid crystal display device according to a second embodiment of the present invention. In the present embodiment, a configuration of a preprocessing unit 100 differs from that of the above-described first embodiment. The preprocessing unit 100 in the present embodiment is provided with a white field memory 13(W) in addition to the components of the first embodiment. A detailed description of the same points as those of the first embodiment is omitted below.

A signal separation circuit 11 in the preprocessing unit 100 separates an input image signal DIN transmitted from an external source into white input gradation data Win, red input-gradation data Rin, green input gradation data Gin, and blue input gradation data Bin.

A data correction circuit 12 in the preprocessing unit 100 performs a compression process and a correction process for overdrive on the input gradation data (the white input gradation data Win, the red input gradation data Rin, the green input gradation data Gin, and the blue input gradation data Bin) outputted from the signal separation circuit 11, and outputs compressed data (compressed data Wpb for a white field, compressed data Rpb for a red field, compressed data Gpb for a green field, and compressed data Bpb for a blue field) obtained in those processes.

The white field memory 13(W), a red field memory 13(R), a green field memory 13(G), and a blue field memory 13(B) respectively store the compressed data Wpb for a white field, compressed data Rpb for a red field, compressed data Gpb for a green field, and compressed data Bpb for a blue field which are outputted from the data correction circuit 12.

Figure 15:
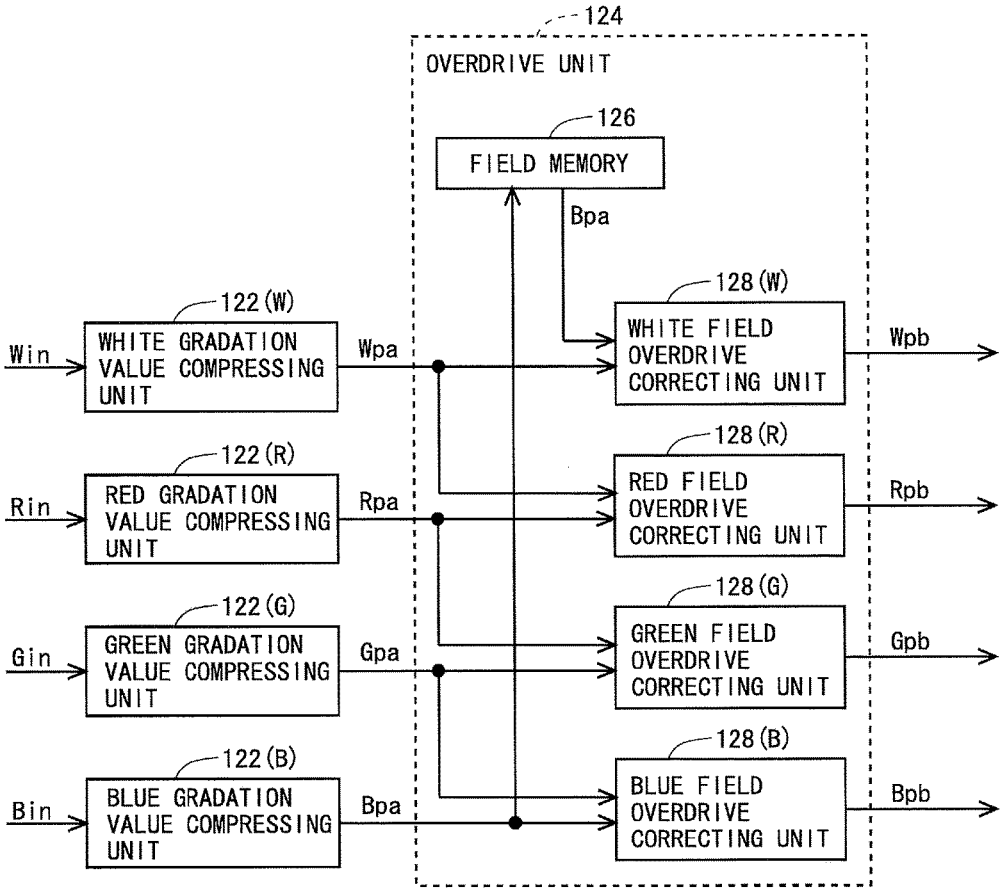
FIG. 15 is a block diagram showing a configuration of a data correction circuit in the second embodiment.

FIG. 15 is a block diagram showing a configuration of the data correction circuit 12 in the present embodiment. As can be grasped from FIGS. 4 and 15, in the present embodiment, the data correction circuit 12 is provided with a white gradation value compressing unit 122(W) and a white field overdrive correcting unit 128(W) in addition to the components of the first embodiment. The data correction circuit 12 performs the same operation as that of the first embodiment except that a process for a red field, a process for a green field, and a process for a blue field are sequentially performed after performing a process for a white field. Therefore, a detailed description of the data correction circuit 12 is omitted.

Figure 16:
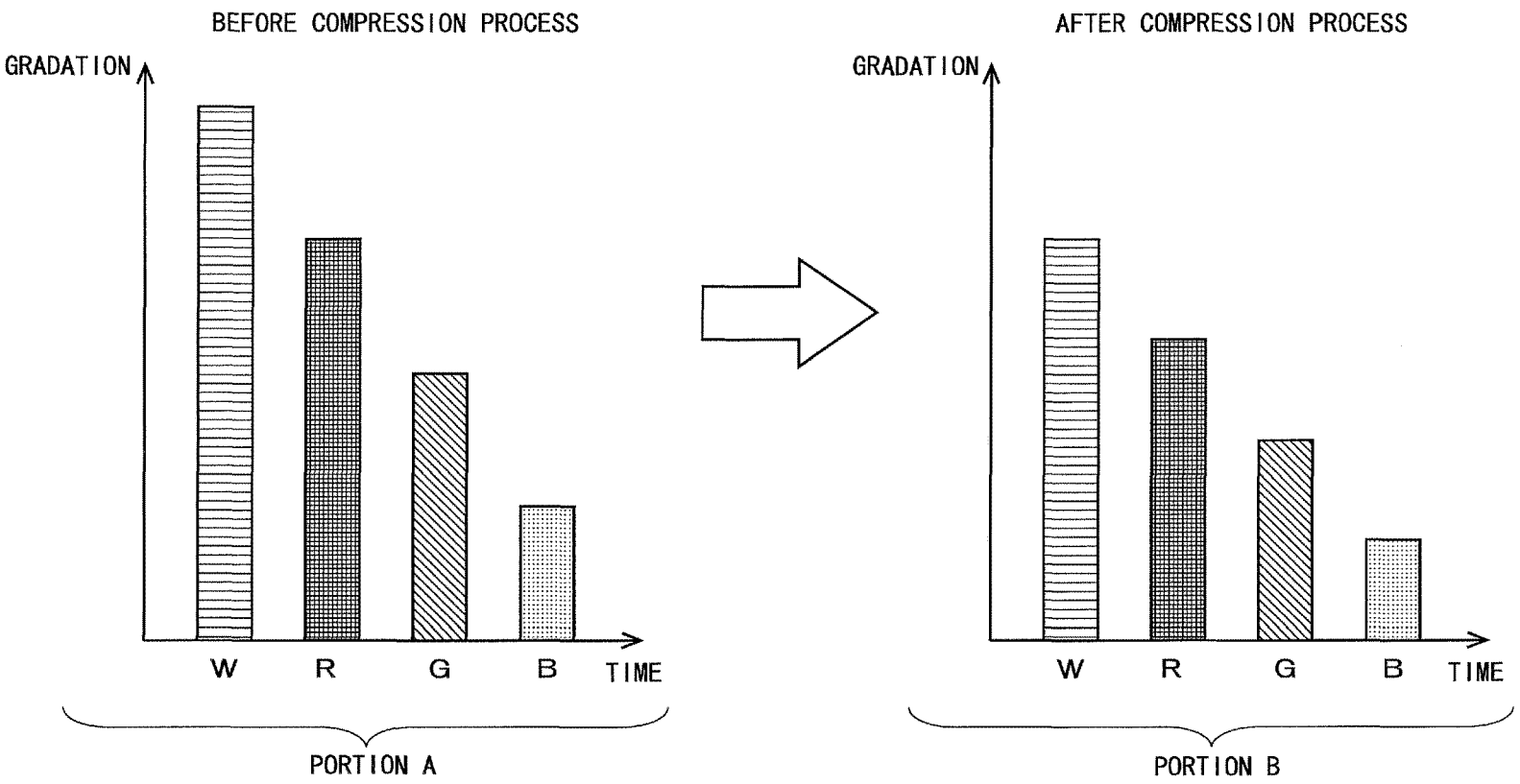
FIG. 16 is a diagram for describing a compression process in the second embodiment.

By the data correction circuit 12 configured in the above-described manner, in the present embodiment, a compression process for compressing a gradation value is performed on each of white, red, green, and blue input gradation data. By this, for example, input gradation data having gradation values such as those shown in portion A of FIG. 16 is converted into compressed data having gradation values such as those shown in portion B of FIG. 16.

<2.3 Effects>

Figure 17:
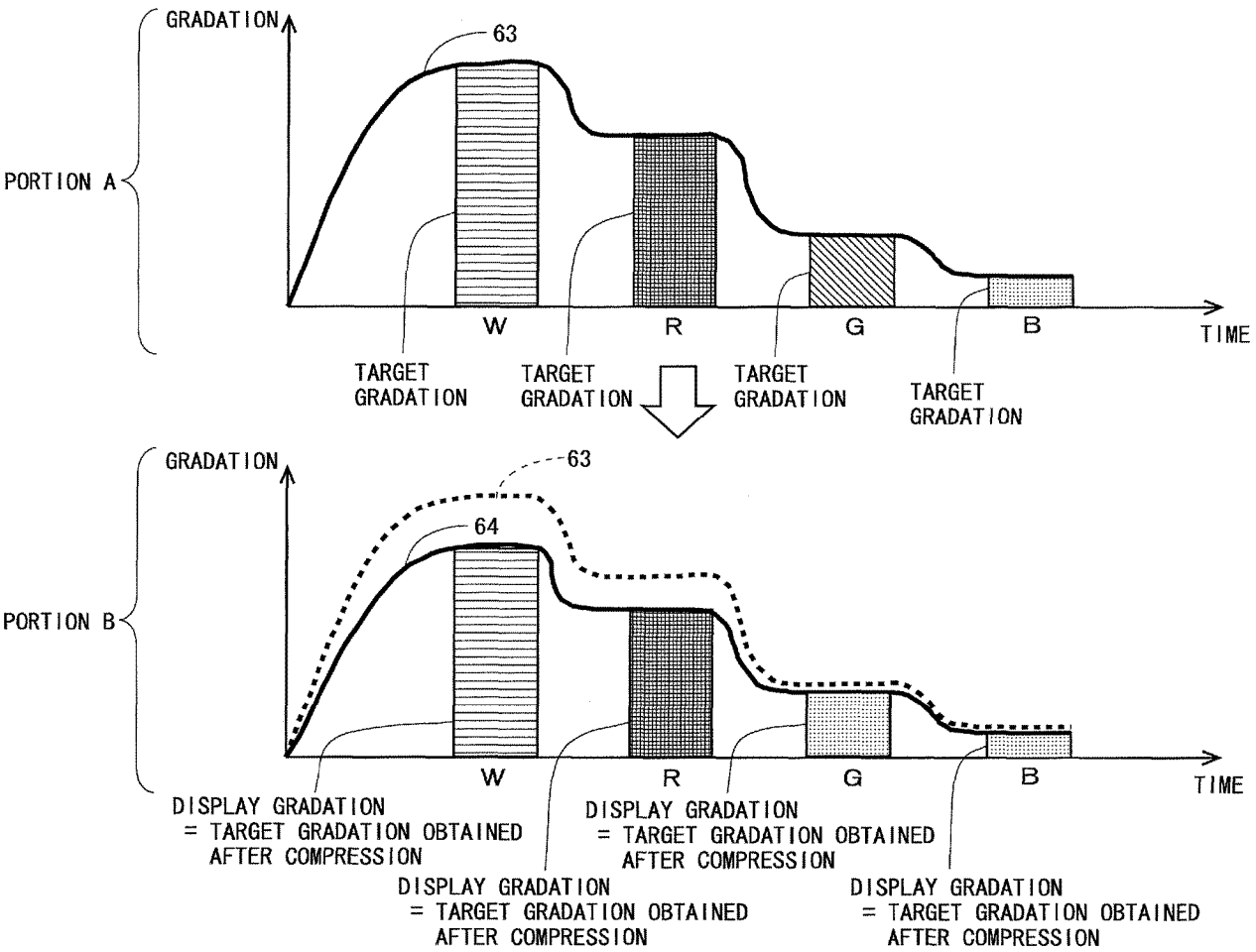
FIG. 17 is a diagram for describing an effect in the second embodiment.

According to the present embodiment, in a liquid crystal display device employing the field sequential system, in which one frame period is composed of four fields (a white field, a red field, a green field, and a blue field), as in the above-described first embodiment, the gradation values of all input gradation data are compressed at a certain ratio by a compression process. Thus, for example, when input gradation data having target gradations such as those shown in portion A of FIG. 17 is provided, the gradation values of the input gradation data of all colors are reduced at a certain ratio, by which gradation changes depending on target gradations obtained after a compression process occur as indicated, by reference character 64 in portion B of FIG. 17. As such, it becomes possible to display a color such that the liquid crystal responds as intended in each field without impairing color balance. In addition, in the present embodiment, one frame period includes a white field in which color mixture components of three primary colors are displayed, in addition to three fields in which single-color display of each of the three primary colors is performed. Hence, the occurrence of color breakup is suppressed. By the above, according to the present embodiment, a liquid crystal display device employing the field sequential system is implemented that is capable of suppressing the occurrence of color breakup and suppressing the degradation of image quality caused by liquid crystal response characteristics.

<3. Third Embodiments>

<3.1 Overview>

In the above-described first and second embodiments, the value of a compression coefficient K used in a compression process is constant regardless of the magnitude of a gradation value of input gradation data. Hence, the gradation values of data of all colors are reduced at a certain ratio. Therefore, the lightness of a displayed color becomes lower than that of the original color and a reduction in the maximum luminance of a displayed image is unavoidable. In view of this, in the present embodiment, regarding a liquid crystal display device of employing the field sequential system, a configuration that allows to suppress the degradation of image quality caused by liquid crystal response characteristics without reducing the maximum luminance is adopted.

<3.2 Configuration and How to Set a Compression Coefficients>

As for an overall configuration and a configuration of a data correction circuit 12, the same configurations as those of the first embodiment (see FIGS. 2 and 4) may be adopted, or the same configurations as those of the second embodiment (see FIGS. 14 and 15) may be adopted. The present embodiment differs from the first and second embodiments in how to set the compression coefficient K.

Figure 18:
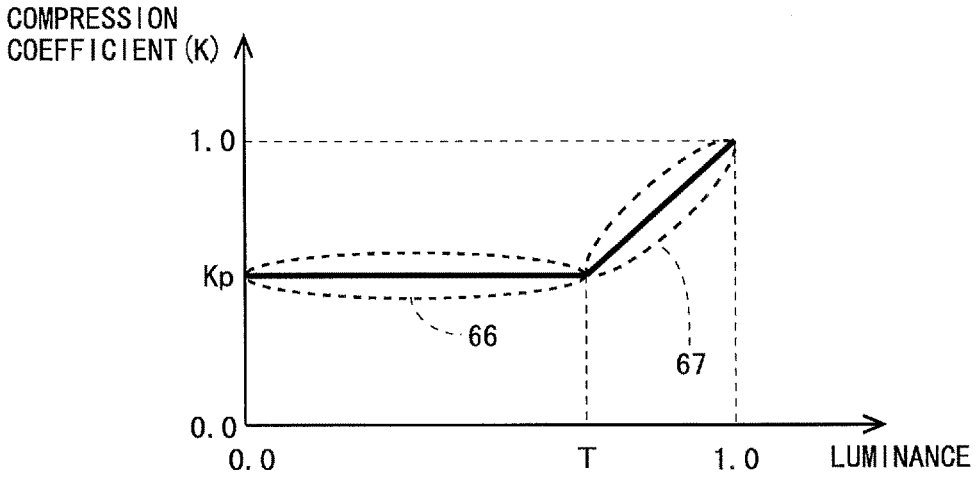
FIG. 18 is a diagram for describing how to set a compression coefficient in a third embodiment of the present invention.

How to set the compression coefficient K in the present embodiment will be described with reference to FIG. 18. As for FIG. 18, a horizontal axis represents the luminance (the value normalized such that the maximum luminance is 1.0) corresponding to the gradation value of input gradation data, and a vertical axis represents the compression coefficient K used upon a compression process. As can be grasped from FIG. 18, in the present embodiment, regarding input gradation data with a luminance lower than or equal to a predetermined value (threshold value) T, a compression process is performed using a compression coefficient K set to a constant value Kp less than 1, and regarding input gradation data with a luminance higher than the predetermined value T, a compression process is performed using a compression coefficient K whose; value increases as the luminance increases. As such, in the present embodiment, the gradation value compressing unit 122 determines the value of a compression coefficient K used upon a compression process, depending on the magnitude of the value of input gradation data. Note that specific values of T and Kp are determined based on the color reproducibility, display quality, etc., required for the liquid crystal display device.

Next, a specific method for determining a compression coefficient K by the gradation value compressing unit 122 will be described. Here, as in the above-described first embodiment, it is assumed that one frame period is composed of three fields (a red field, a green field, and a blue field). In the present embodiment, the value of a compression coefficient K is determined for each pixel, based on an average value of the value of red input gradation data Rin, the value of green input gradation data Gin, and the value of blue input gradation data Bin. Note that the value of each input gradation data used here is a value obtained by normalizing a luminance corresponding to a gradation value such that the maximum luminance is 1.0. More specifically, if the average value is less than or equal to the predetermined value T, then the value of the compression coefficient K is set to a constant value less than 1 as indicated by reference character 66 in FIG. 18, and if the average value is greater than the predetermined value T, then a larger value is set for the compression coefficient K for a larger value of input gradation data as indicated by reference character 67 in FIG. 18. Note that the larger the value of the compression coefficient K, the smaller the degree of compression of a gradation value.

Regarding a case in which the average value is greater than the predetermined value T, more specifically, the average value itself is set as the value of the compression coefficient K. Therefore, if the values of red, green, and blue input gradation data are 1.0, 0.9, and 0.8, respectively, then the value of the compression coefficient K is set to 0.9. In addition, if the values of red, green, and blue input gradation data are all 1.0, then the value of the compression coefficient K is set to 1.0.

As described above, in the present embodiment, the gradation value compressing unit 122 performs a compression process using a compression coefficient K set to a constant value less than 1 when an average value of the value of red input gradation data Rin, the value of green input gradation data Gin, and the value of blue input gradation data Bin is less than or equal to the predetermined value (threshold value) T, and performs a compression process using a compression coefficient K set to a value equal to the average value when the average value is greater than the predetermined value T.

<3.3 Effects>

Figure 19:
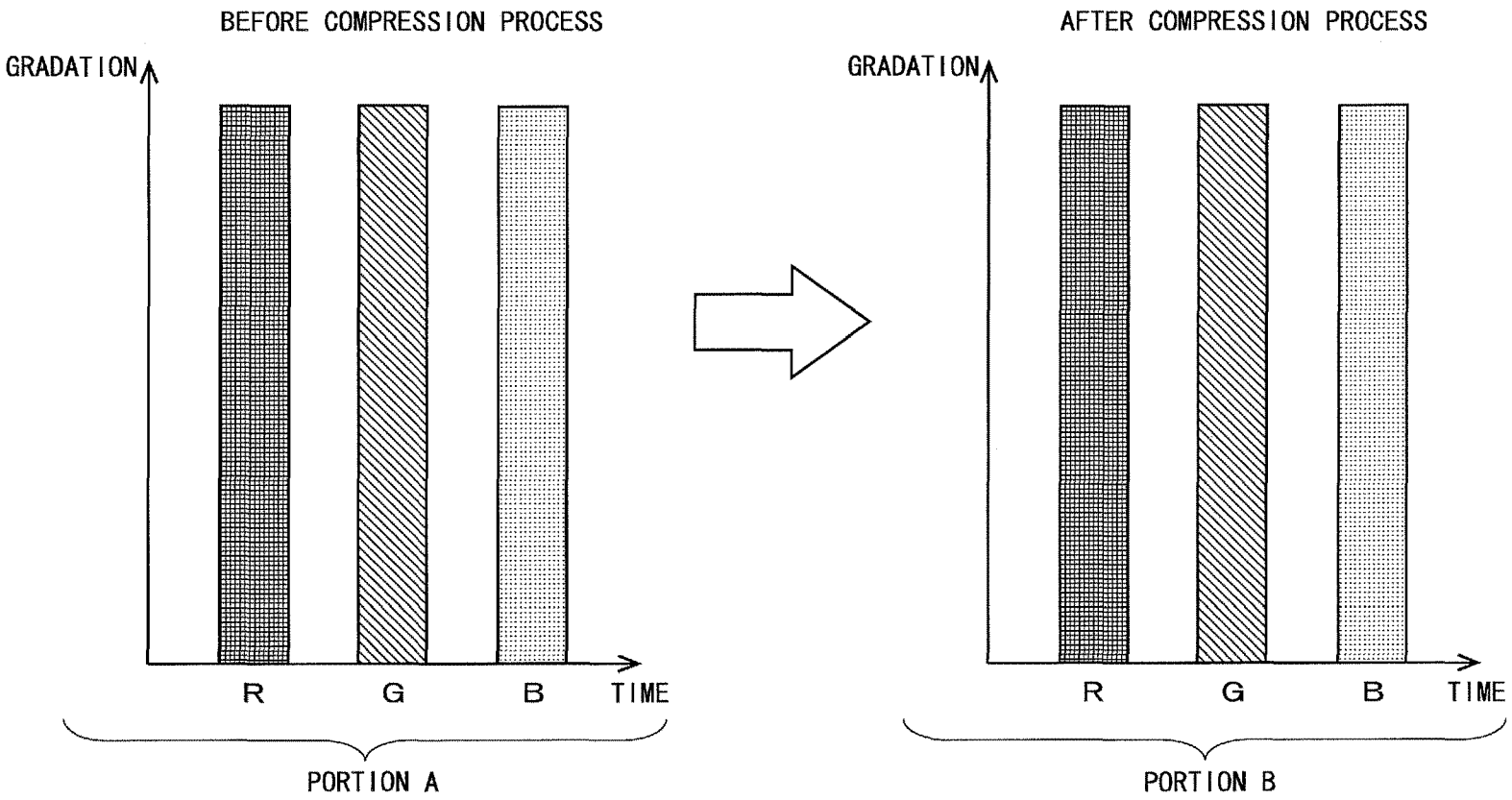
FIG. 19 is a diagram for describing an effect in the third embodiment.

According to the present embodiment, regarding each pixel, if an average value of the value of red input gradation data Rin, the value of green input gradation data Gin, and the value of blue input gradation data Bin is greater than the predetermined value T, then a larger value is set for a compression coefficient K used upon a compression process for a larger average value. More specifically, if the average value is greater than the predetermined value T, then the compression coefficient K is set to a value equal to the average value. By the above, as for high-gradation data, the degree of compression of a gradation value is small. For example, as described above, when the values of red, green, and blue input gradation data are all 1.0, the value of the compression coefficient K is set to 1.0. In this case, as shown in FIG. 19, gradation values do not change at all before and after the compression process. Therefore, the maximum luminance does not decrease. As described above, according to the present embodiment, a liquid crystal display device employing the field sequential system is implemented that is capable of suppressing the degradation of image quality caused by liquid crystal response characteristics, without reducing the maximum luminance.

<4. Fourth Embodiment>

<4.1 Overview>

In the above-described third embodiment, a compression coefficient K for input gradation data for a given pixel (hereinafter, referred to as "target pixel") is determined based on only the value of the input gradation data for the target pixel. However, if the compression coefficient K is determined in this manner, then a displayed image may not have a smooth color change in a case in which the compression coefficient K is greatly different between adjacent pixels. Hence, in the present embodiment, a configuration that allows to obtain a displayed image with a smooth color change is adopted.

<4.2 Configuration and How to Set a Compression Coefficient>

As for an overall configuration and a configuration of a data correction circuit 12, the same configurations as those of the first embodiment (see FIGS. 2 and 4) may be adopted, or the same configurations as those of the second embodiment (see FIGS. 14 and 15) may be adopted. Note, however, that here it is assumed that the same configurations as those of the first embodiment are adopted. How to set a compression coefficient K is substantially the same as that of the third embodiment. Note, however, that how to determine an average value upon determining a compression coefficient K differs from that of the third embodiment.

In the third embodiment, the gradation value compressing unit 122 determines an average value of the values of input gradation data (the value of red input gradation data Rin, the value of green input gradation data Gin, and the value of blue input gradation data Bin) for a target pixel, using only the values of the input gradation data for the target pixel. In the present embodiment, on the other hand, the gradation value compressing unit 122 determines an average value of the values of input gradation data for a target pixel, using the values of input gradation data for a plurality of pixels including the target pixel and pixels therearound. As such, the gradation value compressing unit 122 determines a compression coefficient K which is used upon a compression process for input gradation data for a target pixel, based on an average value of the values of input gradation data for a plurality of pixels including the target pixel and pixels therearound.

Figure 20:
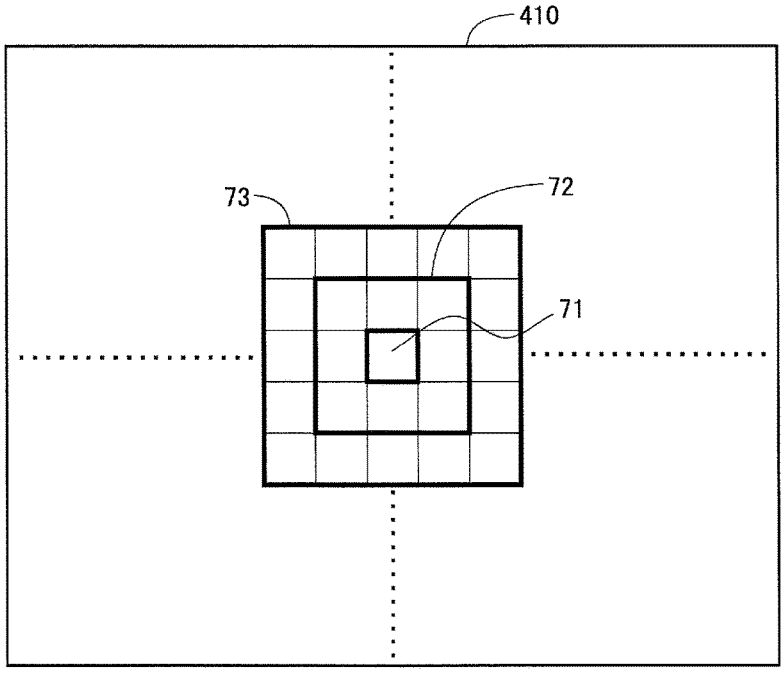
FIG. 20 is a diagram for describing how to set a compression coefficient in a fourth embodiment of the present invention.

When assuming that a pixel indicated by reference character 71 in FIG. 20 is a target pixel, calculation of the above-described average value is performed using, for example, the values of input gradation data for pixels in a region indicated by reference character 72 in FIG. 20. Note that calculation of the average value may be performed using the values of input gradation data for pixels in the region indicated by reference character 73 in FIG. 20, or may be performed using the values of input gradation data for pixels in any other region.

In the present embodiment, a compression process for compressing a gradation value is performed on input gradation data for each pixel, using a compression coefficient K determined in the above-described manner.

<4.3 Effects>

Figure 21:
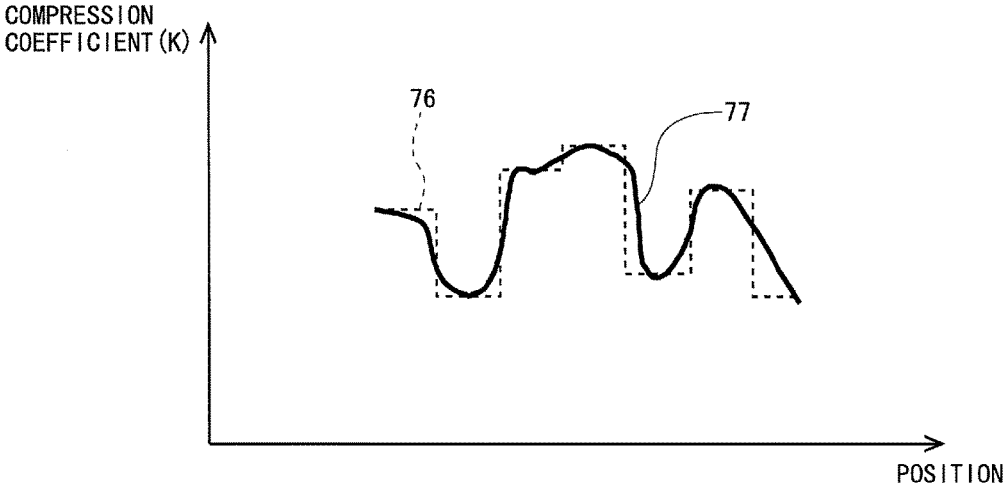
FIG. 21 is a diagram for describing an effect in the fourth embodiment.

According to the present embodiment, the value of a compression coefficient K used in a compression process is determined based on an average value of input gradation data. More specifically, when any pixel is defined as a target pixel, the value of a compression coefficient K which is used upon a compression process for input gradation data for the target pixel is determined based on an average value of the values of input gradation data for a plurality of pixels including the target pixel and pixels therearound. By this, for example, although a relationship between the position in the display unit 410 and the value of the compression coefficient K is represented by a dotted line indicated by reference character 76 in FIG. 21 in the above-described third embodiment, the relationship is represented by a solid line indicated by reference character 77 in FIG. 21 in the present embodiment. As such, the value of the compression coefficient K is prevented from greatly changing between adjacent pixels. Therefore, an image with a smooth color change is displayed. As described above, according to the present embodiment, a liquid crystal display device employing the field sequential system is implemented that is capable of suppressing the degradation of image quality caused by liquid crystal response characteristics, without reducing the maximum luminance, and capable of obtaining a displayed image with a smooth color change.

<5. Others>

The present invention is not limited to the above-described embodiments, and various modifications may be made thereto without departing from the true spirit and scope of the present invention. For example, the present invention can also be applied to a case in which one frame period is divided into five or more fields. In addition, the present invention can also be applied to a liquid crystal display device that performs a local dimming process in which a screen is logically divided into a plurality of areas and the luminance of a backlight (light source) is controlled on an area-by-area basis.

DESCRIPTION OF REFERENCE CHARACTERS

11: SIGNAL SEPARATION CIRCUIT
12: DATA CORRECTION CIRCUIT
100: PREPROCESSING UNIT
122: GRADATION VALUE COMPRESSING UNIT
122(R): RED GRADATION VALUE COMPRESSING UNIT
122(G): GREEN GRADATION VALUE COMPRESSING UNIT
122(B): BLUE GRADATION VALUE COMPRESSING UNIT
124: OVERDRIVE UNIT
126: FIELD MEMORY
128: OVERDRIVE CORRECTING UNIT
128(R): RED FIELD OVERDRIVE CORRECTING UNIT
128(G): GREEN FIELD OVERDRIVE CORRECTING UNIT
128(B): BLUE FIELD OVERDRIVE CORRECTING UNIT
129: GRADATION VALUE CONVERSION LOOKUP TABLE
200: TIMING CONTROLLER
310: GATE DRIVER
320: SOURCE DRIVER
330: LED DRIVER
400: LIQUID CRYSTAL PANEL
410: DISPLAY UNIT
490: BACKLIGHT

The invention claimed is:

1. A liquid crystal display device employing a field sequential system, the liquid crystal display device performing color display by dividing one frame period into a plurality of fields and rewriting a screen on a field-by-field basis, the liquid crystal display device comprising:

a liquid crystal panel configured to display an image formed of a plurality of pixels;

a gradation value compressing unit configured to generate compressed data by performing a compression process, the compression process being a process of correcting input gradation data such that a difference between a maximum gradation value and a minimum gradation value is reduced; and a liquid crystal panel driving unit configured to drive the liquid crystal panel based on the compressed data, wherein the gradation value compressing unit performs the compression process such that values of input gradation data of a plurality of colors change at a same ratio, the plurality of colors corresponding to the plurality of fields, the gradation value compressing unit determines a value of the compressed data by multiplying a value of the input gradation data by a compression coefficient, the compression coefficient being a value greater than 0 and less than or equal to 1, and the gradation value compressing unit determines the value of the compression coefficient used upon the compression process, depending on a magnitude of the value of the input gradation data.

2. The liquid crystal display device according to claim 1, wherein the gradation value compressing unit:

uses a compression coefficient set to a constant value less than 1 upon the compression process, when the value of the input gradation data is less than or equal to a predetermined threshold value; and increases the value of the compression coefficient used upon the compression process as the value of the input gradation data increases, when the value of the input gradation data is greater than the threshold value.

3. The liquid crystal display device according to claim 2, wherein the input gradation data includes red input gradation data, green input gradation data, and blue input gradation data, and the gradation value compressing unit:

uses a compression coefficient set to a constant value less than 1 upon the compression process, when an average value of a value of the red input gradation data, a value of the green input gradation data, and a value of the blue input gradation data is less than or equal to the threshold value; and increases the value of the compression coefficient used upon the compression process as the average value increases, when the average value is greater than the threshold value.

4. The liquid crystal display device according to claim 3, wherein the gradation value compressing unit sets the value of the compression coefficient used upon the compression process to a value equal to the average value or a value obtained by normalizing the average value, when the average value is greater than the threshold value.

5. The liquid crystal display device according to claim 3, wherein when a processing-target pixel for which the value of the compressed data is determined is defined as a target pixel, the gradation value compressing unit determines a compression coefficient used upon a compression process for input gradation data for the target pixel, based on an average value of values of input gradation data for a plurality of pixels including the target pixel and pixels around the target pixel.

6. The liquid crystal display device according to claim 1, further comprising a compression process lookup table configured to hold a plurality of input values and a plurality of output values, the plurality of input values being values associated with the input gradation data and values that can be taken by the input gradation data, and the plurality of output values being values associated with the compressed data and values provided to have a one-to-one correspondence with the plurality of input values, wherein the gradation value compressing unit determines a value of the compressed data by referring to the compression process lookup table based on a value of the input gradation data.

7. The liquid crystal display device according to claim 1, wherein one frame period is divided into four fields including a white field in which a white screen is displayed, a red field in which a red screen is displayed, a green field in which a green screen is displayed, and a blue field in which a blue screen is displayed.

8. The liquid crystal display device according to claim 1, further comprising an overdrive correcting unit configured to perform correction that emphasizes a temporal change of the compressed data that is generated by the gradation value compressing unit.

9. A method for driving a liquid crystal display device employing a field sequential system, the liquid crystal display device including a liquid crystal panel displaying an image formed of a plurality of pixels and configured to perform color display by dividing one frame period into a plurality of fields and rewriting a screen on a field-by-field basis, the method comprising:

a gradation value compressing step of generating compressed data by performing a compression process, the compression process being a process of correcting input gradation data such that a difference between a maximum gradation value and a minimum gradation value is reduced; and a liquid crystal panel driving step of driving the liquid crystal panel based on the compressed data, wherein in the gradation value compressing step, the compression process is performed such that values of input gradation data of a plurality of colors change at a same ratio, the plurality of colors corresponding to the plurality of fields, in the gradation value compressing step, a value of the compressed data is determined by multiplying a value of the input gradation data by a compression coefficient, the compression coefficient being a value greater than 0 and less than or equal to 1, and in the gradation value compressing step, the value of the compression coefficient used upon the compression process is determined depending on a magnitude of the value of the input gradation data.

* * * * *